US010294630B2

(12) United States Patent
Elkins

(10) Patent No.: US 10,294,630 B2
(45) Date of Patent: May 21, 2019

(54) METHOD AND SYSTEM FOR CREATING A FINAL GRADED SOIL SURFACE HAVING A FINAL SOIL DEPTH

(71) Applicant: CNH Industrial America, LLC, New Holland, PA (US)

(72) Inventor: Scott Andrew Elkins, Plainfield, IL (US)

(73) Assignee: CNH Industrial America LLC, New Holland, PA (US)

( * ) Notice: Subject to any disclaimer, the term of this patent is extended or adjusted under 35 U.S.C. 154(b) by 5 days.

(21) Appl. No.: 15/696,256

(22) Filed: Sep. 6, 2017

(65) Prior Publication Data

US 2019/0071841 A1 Mar. 7, 2019

(51) Int. Cl.
*E02F 3/84* (2006.01)
*E02F 3/76* (2006.01)
*E02F 9/26* (2006.01)

(52) U.S. Cl.
CPC ..... *E02F 3/844* (2013.01); *E02F 3/7618* (2013.01); *E02F 9/262* (2013.01)

(58) Field of Classification Search
CPC ..... E02F 3/844; E02F 3/7618; E02F 9/262
USPC ..... 701/50
See application file for complete search history.

(56) References Cited

U.S. PATENT DOCUMENTS 2,899,760 A 8/1959 Armington et al.
2,933,838 A 4/1960 Rockwell
5,826,666 A * 10/1998 Tozawa ..... E02F 3/437 172/7
5,960,569 A 10/1999 Molstad
6,665,067 B2 * 12/2003 Ogawa ..... E02F 3/437 356/247
7,814,670 B2 * 10/2010 Katayama ..... G01C 15/06 172/4.5
9,066,465 B2 * 6/2015 Hendrickson ..... A01B 79/005
9,326,442 B1 * 5/2016 Bergmeier ..... A01C 5/062
9,433,142 B2 * 9/2016 Bergen ..... A01C 5/06
2009/0025944 A1 * 1/2009 Bassett ..... A01B 63/045 172/1

(Continued)

FOREIGN PATENT DOCUMENTS

WO 2012/150867 A1 11/2012

OTHER PUBLICATIONS

European Search Report for EP Application No. 18.192.621.3 dated Jan. 10, 2019 (six pages).

*Primary Examiner* — Yazan A Soofi
(74) *Attorney, Agent, or Firm* — Peter K. Zacharias

(57) ABSTRACT

In one aspect, a method for creating a final graded soil surface may include controlling an operation of a grading implement of a work vehicle such that the grading implement removes a layer of soil from a current soil surface as the work vehicle is moved in a forward direction. The method may also include receiving an input indicative of the current soil surface being at an offset soil depth relative to the initial ungraded soil surface, with the offset soil depth differing from the final soil depth. When the current soil surface is at the offset soil depth, the method may further include adjusting a position of the grading implement to add or remove soil based on a depth differential defined between the offset soil depth and the final soil depth to create the final graded soil surface as the work vehicle is moved in the reverse direction.

20 Claims, 7 Drawing Sheets

(56) References Cited

U.S. PATENT DOCUMENTS

| | | | | |
|---|---|---|---|---|
| 2009/0120340 | A1* | 5/2009 | Steinlage ..... | A01B 15/025<br>111/123 |
| 2015/0373897 | A1* | 12/2015 | Larsen ..... | A01B 21/086<br>172/175 |
| 2016/0258129 | A1 | 9/2016 | Wei et al. | |

* cited by examiner

METHOD AND SYSTEM FOR CREATING A FINAL GRADED SOIL SURFACE HAVING A FINAL SOIL DEPTH

FIELD

The present disclosure generally relates to work vehicles and, more particularly, to methods and systems for using work vehicles to create a final graded soil surface having a final soil depth relative an initial ungraded soil surface by adding or removing soil to a current soil surface when the current soil surface is at an offset soil depth that differs from the final soil depth.

BACKGROUND

It is well known that, in the construction of many buildings, bridges, roads, and/or the like, that the topography of the soil must be manipulated, typically through the use a grading operation. Grading operations are generally performed by a work vehicle, such as a crawler dozer, that includes a grading implement, such as a blade, configured to remove a layer of soil from a current soil surface. The work vehicle typically includes a pair of tracks for use in traversing the current soil surface.

The grading implement is generally located at a forward end of the work vehicle so as to push a layer of soil in front of the work vehicle as the work vehicle is moved in a forward direction. However, considering the large size and weight of many work vehicles configured to perform grading operations, the tracks of such work vehicles may leave grooves or other indentions in the final graded surface. As such, it is necessary to use smaller, lighter work vehicles to remove the grooves or indentions, which increases the time and cost of the construction project.

Accordingly, an improved method and system for creating a final graded soil surface having a final soil depth relative an initial ungraded soil surface would be welcomed in the technology.

BRIEF DESCRIPTION

Aspects and advantages of the technology will be set forth in part in the following description, or may be obvious from the description, or may be learned through practice of the technology.

In one aspect, the present subject matter is directed to a method for creating a final graded soil surface having a final soil depth relative to an initial ungraded soil surface. The method may include controlling, with a computing device, an operation of a grading implement of a work vehicle such that the grading implement removes a layer of soil from a current soil surface as the work vehicle is moved in a forward direction. The work vehicle may extend longitudinally between a forward end and an aft end. The grading implement may be located at the forward end of the work vehicle. The grading implement may traverse the current soil surface prior to the aft end of the work vehicle when work vehicle is moved in the forward direction. The aft end of the work vehicle may traverse the current soil surface prior to the grading implement when work vehicle is moved in a reverse direction. The method may also include receiving, with the computing device, an input indicative of the current soil surface being at an offset soil depth relative to the initial ungraded soil surface, with the offset soil depth differing from the final soil depth. When the current soil surface is at the offset soil depth, the method may further include adjusting, with the computing device, a position of the grading implement so as to add or remove soil based on a depth differential defined between the offset soil depth and the final soil depth to create the final graded soil surface as the work vehicle is moved in the reverse direction.

In another aspect, the present subject matter is directed to a system for creating a final graded soil surface having a final soil depth relative to an initial ungraded soil surface. The system may include a work vehicle extending longitudinally between a forward end and an aft end. The work vehicle may include a grading implement positioned at the forward end of the work vehicle. The work vehicle may be configured to be moved in both a forward direction and a reverse direction. The grading implement may traverse a current soil surface prior to the aft end of the work vehicle when the work vehicle moves in the forward direction. The aft end of the work vehicle may traverse the current soil surface prior to the grading implement when the work vehicle moves in the reverse direction. The system may also include a controller communicatively coupled to the work vehicle. The controller may be configured to position the grading implement at an offset soil depth relative to the initial ungraded soil surface such that the current soil surface is graded to the offset soil depth as the work vehicle is moved in the forward direction across the soil surface, with the offset soil depth differing from the final soil depth. When the current soil surface is at the offset soil depth, the controller may be configured to adjust the position of the grading implement so as to add or remove soil based on a depth differential defined between the offset soil depth and the final soil depth to create the final graded soil surface as the work vehicle is moved in the reverse direction across the soil surface.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
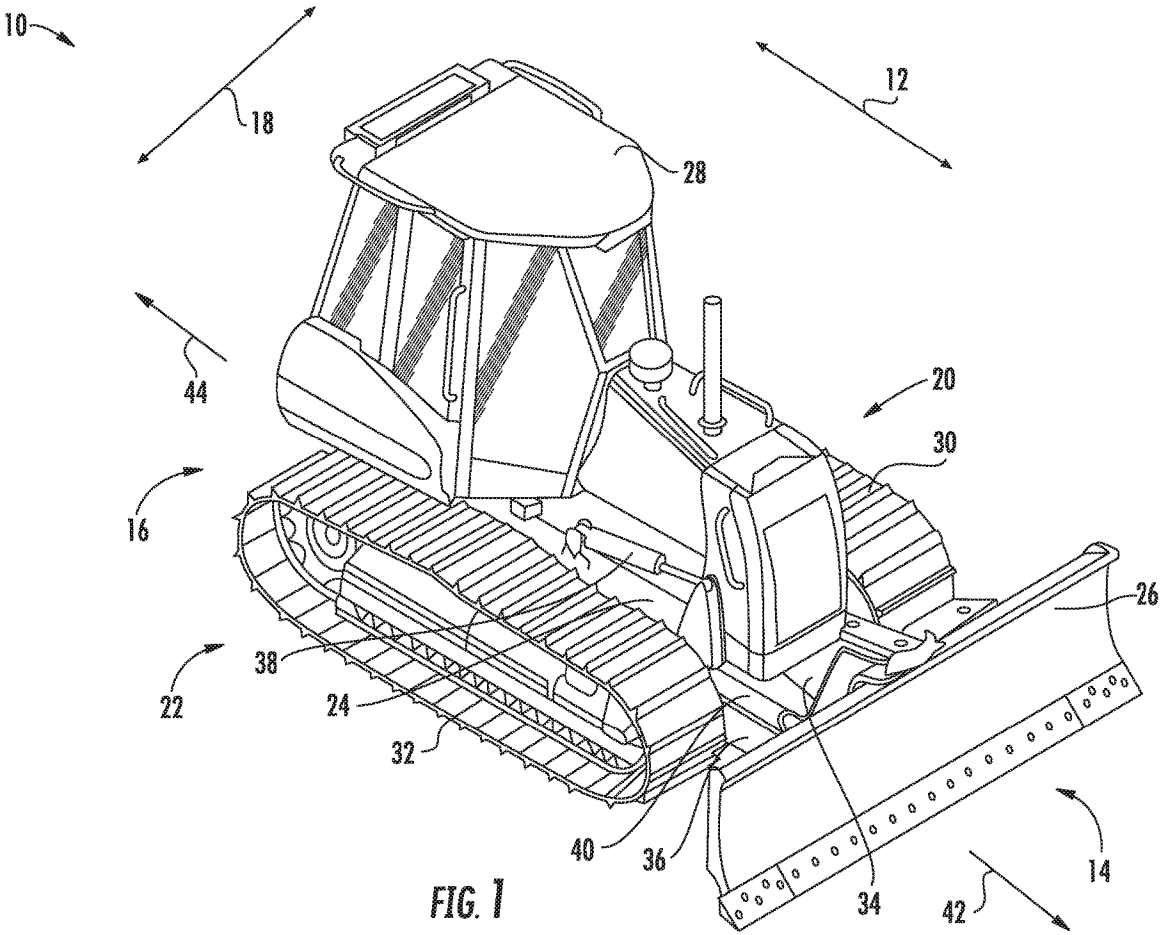
FIG. 1 illustrates a perspective view of one embodiment of a work vehicle in accordance with aspects of the present subject matter.

Repeat use of reference characters in the present specification and drawings is intended to represent the same or analogous features or elements of the present technology.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to methods and systems for creating a final graded soil surface having a final soil depth relative to an initial ungraded soil surface. Specifically, in several embodiments, a controller may be configured to control an operation of a grading implement of a work vehicle such that the grading implement removes a layer of soil from a current soil surface as the work vehicle is moved in a forward direction. The controller may also be configured to receive an input indicative of the current soil surface being at an offset soil depth relative to the initial ungraded soil surface that differs from the desired final soil depth, such as an input from a sensor or an operator of the work vehicle. When the current soil surface is at the offset soil depth, the controller may be configured to adjust a position of the grading implement so as to add or remove soil based on a depth differential defined between the offset soil depth and the desired final soil depth to create the final graded soil surface as the work vehicle is moved in a reverse direction. For example, in one embodiment, when the offset depth is greater than the final soil depth, the controller may be configured to control a depth and/or angle of the grading implement so as to add soil to create the final graded soil surface as the work vehicle is moved back across the previously graded surface in the reverse direction. Similarly, when the offset depth is less than the final soil depth, the controller may be configured to control a depth and/or angle of the grading implement so as to remove soil to create the final graded soil surface as the work vehicle is moved back across the previously graded surface in the reverse direction. Creating the final grade soil surface by adding or removing soil while the work vehicle is moved in the reverse direction may prevent the formation of any grooves or indentions in the final grade soil surface by tracks or wheels of the work vehicle.

Referring now to the drawings, FIG. 1 illustrates a perspective view of one embodiment of a work vehicle 10. As shown, the work vehicle 10 is configured as a crawler dozer. In general, the work vehicle 10 extends longitudinally (e.g., as indicated by arrow 12 in FIG. 1) between a forward end 14 of the work vehicle 10 and an aft end 16 of the work vehicle 10. In addition, the work vehicle 10 also extends laterally (e.g., as indicated by arrow 18 in FIG. 1) between a first side 20 of the work vehicle 10 and a second side 22 of the work vehicle 10. However, in other embodiments, the work vehicle 10 may be configured as any other suitable work vehicle known in the art, including those for agricultural and construction applications, transport, sport, and/or the like.

As shown in FIG. 1, the work vehicle 10 may include a chassis 24 that is configured to support or couple to a plurality of components. For example, in one embodiment, the chassis 24 may be configured to support a grading implement 26 at the forward end 14 of the work vehicle 10 and an enclosed operator's cab 28 at the aft end 16 of the work vehicle 10. Additionally, a first track assembly 30 may be coupled to the chassis 24 on the first side 20 of the work vehicle 10, and a second track assembly 32 may be coupled to the chassis 24 on the second side 22 of the work vehicle 10. However, it should be appreciated that the chassis 24 may be configured to support or couple to any suitable work vehicle component or configuration of vehicle components.

In accordance with aspects of the present disclosure, the grading implement 26 may be configured to remove a layer of soil from a current soil surface or otherwise move a volume of soil relative to the current soil surface. As shown, the grading implement 26 may be configured as a blade. In several embodiments, the grading implement 26 may be configured to be adjustably mounted to the chassis 24 so as to control the layer of soil removed from the current soil surface by the grading implement 26. For example, as shown, in one embodiment, the grading implement 26 may be adjustably coupled to the chassis 24 by a pair of pivot arms 34, 36. In this regard, the work vehicle 10 may include one or more actuators 38, which are configured to adjust a depth of the grading implement 26 by moving the arms 34, 36 relative to the chassis 24. In addition, the work vehicle 10 may include one or more actuators 40, which are configured to adjust the angle of the grading implement 26 by moving the grading implement 26 relative to the pivot arms 34, 36. It should be appreciated that, in other embodiments, the grading implement 26 may be configured as any suitable type of grading implement, such as a bucket. Furthermore, the grading implement 26 may be coupled to the chassis 24 in any suitable manner.

In several embodiments, the track assemblies 30, 32 of the work vehicle 10 may be configured to move the work vehicle 10 relative to the current soil surface. For example, the track assemblies 30, 32 may be configured to move the work vehicle 10 in a forward direction (e.g., as indicated by arrow 42 in FIG. 1) where the grading implement 26 traverses the current soil surface prior to the aft end 16 of the work vehicle 10. Similarly, the track assemblies 30, 32 may be configured to move the work vehicle 10 in a reverse direction (e.g., as indicated by arrow 44 in FIG. 1) where aft end 16 of the work vehicle 10 traverses the current soil surface prior to the grading implement 26. It should be appreciated that, in some embodiments, the work vehicle 10 may be moved by wheel/tire assemblies (not shown) in addition to or in lieu of the track assemblies 30, 32.

It should be appreciated that the configuration of the work vehicle 10 described above and shown in FIG. 1 is provided only to place the present subject matter in an exemplary field of use. Thus, it should be apparent that the present subject matter may be readily adaptable to any manner of work vehicle configuration. For example, in an alternative embodiment, the work vehicle 10 may include an open operator's cab 18.

Figure 2:
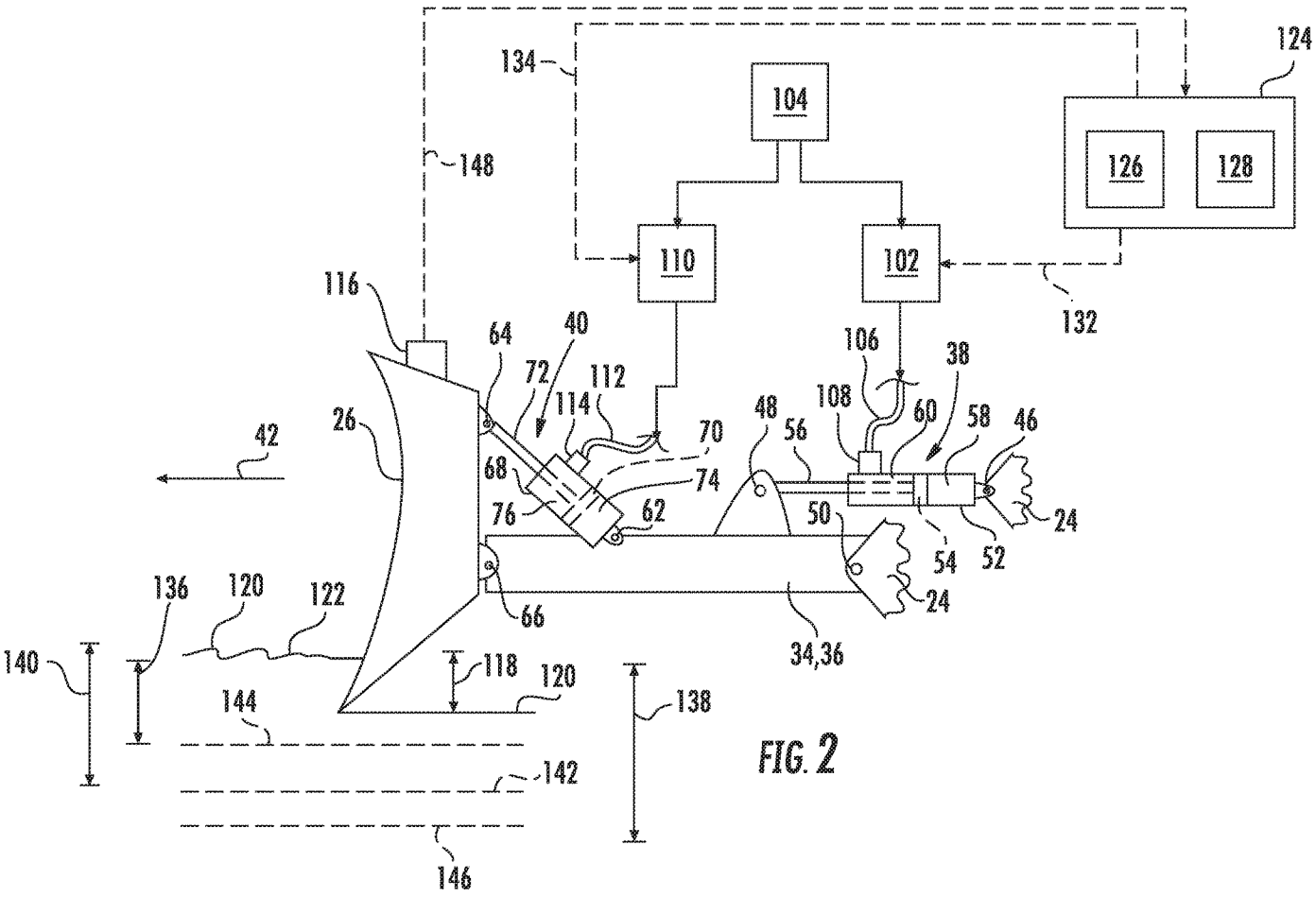
FIG. 2 illustrates a schematic view of one embodiment of a system for creating a final graded soil surface having a final soil depth relative to an initial ungraded soil surface in accordance with aspects of the present subject matter, particularly illustrating the system including a sensor for detecting a parameter associated with a current soil depth of a current soil surface.

Referring now to FIG. 2, a schematic view of one embodiment of a system 100 for creating a final graded soil surface having a final soil depth relative to an initial ungraded soil surface is illustrated in accordance with aspects of the present subject matter. In general, the system 100 will be described herein with reference to the work vehicle 10 described above with reference to FIG. 1. However, it should be appreciated by those of ordinary skill in the art that the disclosed system 100 may generally be utilized with work vehicles having any other suitable work vehicle configuration.

As shown in FIG. 2, the system 100 may include one or more components of the work vehicle 10. For example, the system 100 may include the pivot arms 34, 36, which, as indicated above, may be configured to be pivotable or otherwise moveable relative to the chassis 24 of the work vehicle 10 to permit the actuator(s) 38 to adjust the position of the arms 34, 36 relative to the chassis 24 and the actuator(s) 38. For example, in one embodiment, one end of each actuator 38 may be pivotably coupled to the chassis 24 at a pivot joint 46. Similarly, an opposed end of each actuator 38 may also be coupled to the associated pivot arm 34, 36 at a pivot joint 48. Each pivot arm 34, 36, which may support the grading implement 26, may, in turn, be coupled to the chassis 24 at a pivot joint 50. As such, the pivot joints 46, 48, 50 may allow relative pivotable movement between the chassis 24, the pivot arms 34, 36, and the actuator(s) 38, thereby allowing the position of the pivot arms 34, 36 relative to the chassis 24 to be adjusted. However, a person of ordinary skill in the art would appreciate that the pivot arms 34, 36 may be adjustably coupled to the chassis 24 in any suitable manner that permits the actuator(s) 38 to move the arms 34, 36 relative to the chassis 24.

As shown, each actuator 38 may, for example, correspond to a fluid-driven actuator, such as a hydraulic actuator or a pneumatic actuator. Thus, in several embodiments, each actuator 38 may include a cylinder 52 configured to house a piston 54 and a rod 56 coupled to the piston 54 that extends outwardly from the cylinder 52. Additionally, each actuator 38 may include a cap-side chamber 58 and a rod-side chamber 60 defined within the cylinder 52. As is generally understood, by regulating the pressure of the fluid supplied to one or both of the cylinder chambers 58, 60, the actuation of the rod 56 may be controlled. As shown in FIG. 2, in the illustrated embodiment, the end of the rod 56 is coupled to the associated pivot arm 34, 36 at the pivot joint 48 while the cylinder 52 is coupled to the chassis 24 at the opposed pivot joint 46. However, in an alternative embodiment, the end of the rod 56 may be coupled to the chassis 24 at the pivot joint 46 while the cylinder 52 may be coupled to the associated pivot arm 34, 36 at the pivot joint 48. It should be appreciated that the actuator 38 may be any suitable type of actuator.

In several embodiments, the system 100 may also include a suitable pressure regulating valve 102 (PRV) (e.g., a solenoid-activated valve or a manually operated valve) configured to regulate a supply of fluid (e.g., hydraulic fluid or air from a suitable fluid source or tank 104) being supplied to each actuator 38. As shown in FIG. 2, in one embodiment, the PRV 102 may be in fluid communication with the rod-side chamber 60 of the associated actuator 38. In this respect, the system 100 may include a fluid conduit 106, such as the illustrated hose, that fluidly couples the PRV 102 to a fitting 108 on the associated cylinder 52. As such, the PRV 102 may regulate the supply fluid to the associated rod-side chamber 60. It should be appreciated that, in alternate embodiments, the PRV 102 may be in fluid communication with the associated piston-side chamber 58 to regulate the supply fluid thereto. Alternatively, the system 100 may include a pair of PRVs 102 associated with each actuator 38, with each PRV 102 being in fluid communication with one of the chambers 58, 60 of the associated actuator 38.

The system 100 may also include the vehicle's grading implement 26, which may be configured to be pivotable or otherwise moveable relative to the pivot arms 34, 36 of the work vehicle 10 to permit the actuator(s) 40 to adjust the position of the grading implement 26 relative to the arms 34, 36. For example, in one embodiment, one end of each actuator 40 may be pivotably coupled to the associated pivot arm 34, 36 at a pivot joint 62. Similarly, an opposed end of each actuator 40 may be coupled to the grading implement 26 at a pivot joint 64. The grading implement 26 may, in turn, be coupled to the associated pivot arm 34, 36 at a pivot joint 66. As such, the pivot joints 62, 64, 66 may allow relative pivotable movement between the grading implement 26, the pivot arms 34, 36, and the actuator(s) 40, thereby allowing the position of the grading implement 26 relative to the arms 34, 36 to be adjusted. However, a person of ordinary skill in the art would appreciate that the grading implement 26 may be adjustably coupled to the arms 34, 36 in any suitable manner that permits the actuator(s) 40 to move the grading implement 26 relative to the arms 34, 36.

As shown, each actuator 40 may, for example, correspond to a fluid-driven actuator, such as a hydraulic actuator or a pneumatic actuator. Thus, in several embodiments, each actuator 40 may include a cylinder 68 configured to house a piston 70 and a rod 72 coupled to the piston 70 that extends outwardly from the cylinder 68. Additionally, each actuator 40 may include a cap-side chamber 74 and a rod-side chamber 76 defined within the cylinder 68. As is generally understood, by regulating the pressure of the fluid supplied to one or both of the cylinder chambers 74, 76, the actuation of the rod 72 may be controlled. As shown in FIG. 2, in the illustrated embodiment, the end of the rod 72 is coupled to the grading implement 26 at the pivot joint 64 while the cylinder 68 is coupled to the associated arm 34, 36 at the opposed pivot joint 62. However, in an alternative embodiment, the end of the rod 72 may be coupled to the associated arm 34, 36 at the pivot joint 62 while the cylinder 68 may be coupled to the grading implement 26 at the pivot joint 64. It should be appreciated that the actuator(s) 40 may be any suitable type of actuator.

In several embodiments, the system 100 may also include a suitable pressure regulating valve 110 (PRV) (e.g., a solenoid-activated valve or a manually operated valve) configured to regulate a supply of fluid (e.g., hydraulic fluid or air from the fluid source or tank 104) being supplied to each actuator 40. As shown in FIG. 2, in one embodiment, the PRV 110 may be in fluid communication with the rod-side chamber 76 of the associated actuator 40. In this respect, the system 100 may include a fluid conduit 112, such as the illustrated hose, that fluidly couples the PRV 110 to a fitting 114 on the associated cylinder 68. As such, the PRV 110 may regulate the supply fluid to the associated rod-side chamber 76. It should be appreciated that, in alternate embodiments, the PRV 110 may be in fluid communication with the associated piston-side chamber 74 to regulate the supply fluid thereto. Alternatively, the system 100 may include a pair of PRVs 110 associated with each actuator 40, with each PRV 110 being in fluid communication with one of the chambers 74, 76 of the associated actuator 40.

In accordance with aspects of the present disclosure, the system 100 may also include a sensor 116 configured to detect a parameter indicative of a current soil depth 118 of a current soil surface 120 relative to an initial ungraded soil surface 122. As used herein, the initial ungraded soil surface 122 refers to the soil surface before grading operations have been performed thereon, such as grading operations in accordance with method 200 described below with reference to FIG. 7. In general, the sensor 116 may correspond to any suitable sensor(s) or sensing device(s) that is configured to directly or indirectly detect the current soil depth 118. For example, as shown in FIG. 2, the sensor 116 may be provided in operative association with the grading implement 26. In such embodiments, the sensor 116 may correspond to a LIDAR sensor coupled to the grading implement 26. In this regard, the sensor 102 may be configured to detect a vertical position differential between the grading implement 26 and a fixed point elevation, which may be indicative of the current soil depth 118. However, it should be appreciated that the sensor 116 may correspond to any other suitable sensor(s) or sensing device(s) configured to detect the current soil depth.

As shown in FIG. 2, the system 100 may further include a controller 124 configured to electronically control the operation of one or more components of the work vehicle 10. In general, the controller 124 may comprise any suitable processor-based device known in the art, such as a computing device or any suitable combination of computing devices. Thus, in several embodiments, the controller 124 may include one or more processor(s) 126 and associated memory device(s) 128 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 128 of the controller 124 may generally comprise memory element(s) including, but not limited to, a computer readable medium (e.g., random access memory (RAM)), a computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 128 may generally be configured to store suitable computer-readable instructions that, when implemented by the processor(s) 126, configure the controller 124 to perform various computer-implemented functions, such as one or more aspects of the methods 200 described below with reference to FIG. 7. In addition, the controller 124 may also include various other suitable components, such as a communications circuit or module, one or more input/output channels, a data/control bus and/or the like.

It should be appreciated that the controller 124 may correspond to an existing controller of the work vehicle 10 or the controller 124 may correspond to a separate processing device. For instance, in one embodiment, the controller 124 may form all or part of a separate plug-in module that may be installed within the work vehicle 10 to allow for the disclosed system and method to be implemented without requiring additional software to be uploaded onto existing control devices of the work vehicle 10.

Figure 3:
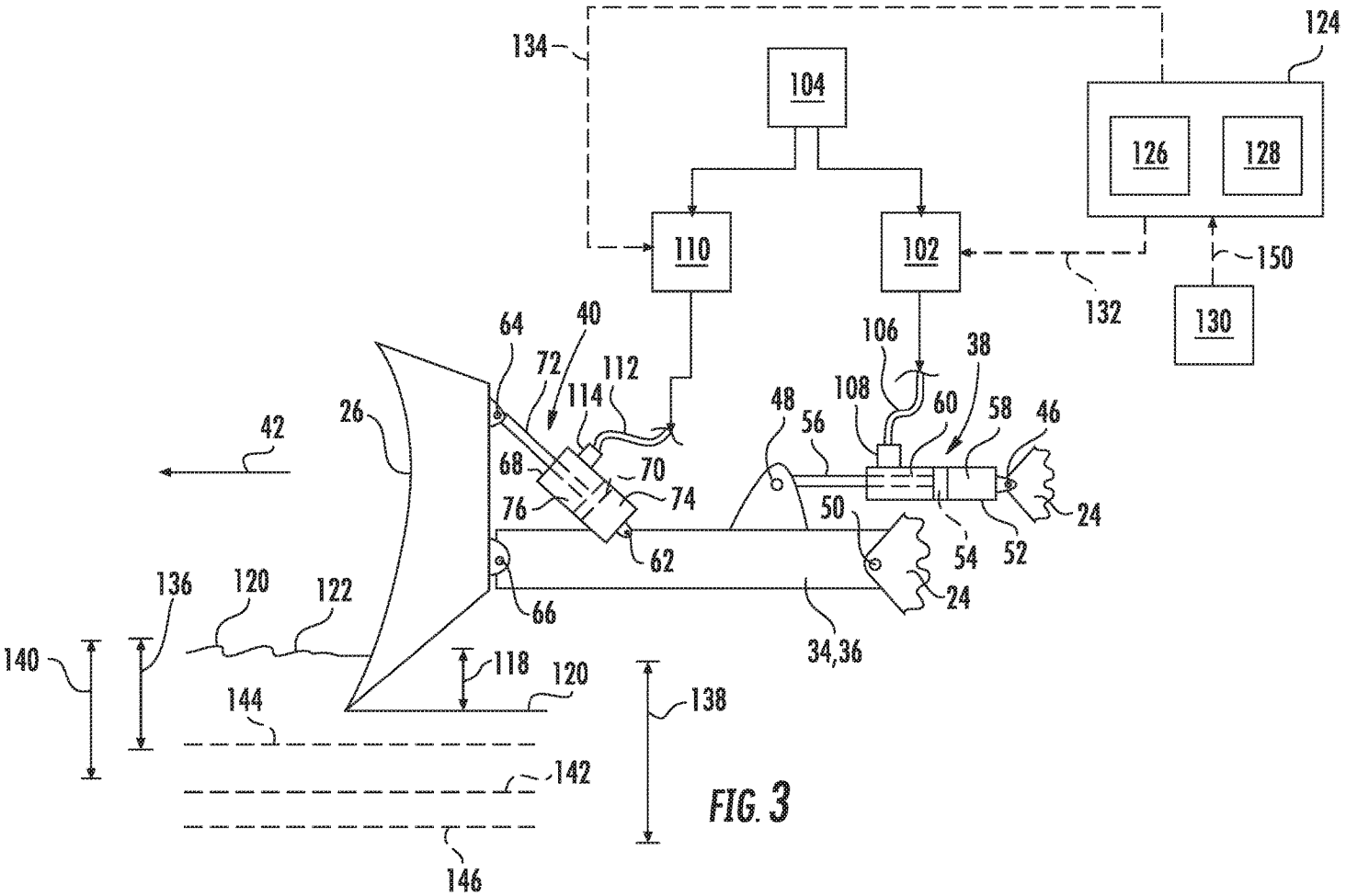
FIG. 3 illustrates a schematic view of a further embodiment of a system for creating a final graded soil surface having a final soil depth relative to an initial ungraded soil surface in accordance with aspects of the present subject matter, particularly illustrating the system including a user interface for receiving a notification when a current soil surface is at an offset soil depth relative to the initial ungraded soil surface.

Referring now to FIG. 3, some embodiments of the system 100 may not include the sensor 116 for detecting a parameter indicative of a current soil depth 118. In such embodiments, the system 100 may include a user interface 130 that is configured to receive an input from an operator of the work vehicle 10, such as an input associated with the current soil depth. As such, the user interface 130 may include one or more input devices (not shown), such as touchscreens, keypads, touchpads, knobs, buttons, sliders, switches, mice, microphones, and/or the like, which are configured to receive user inputs from the operator. In addition, some embodiments of the user interface 130 may include one or more feedback devices (not shown), such as display screens, speakers, warning lights, and/or the like, which are configured to communicate the feedback, such as feedback from the controller 124, to the operator of the work vehicle 10. However, in alternative embodiments, the user interface 130 may have any suitable configuration. Furthermore, it should be appreciated that, in some embodiments, the system 100 may include both the sensor 116 and the user interface 130.

Referring now to FIGS. 2 and 3, the controller 124 may be configured to control an operation of the grading implement 26 of the work vehicle 10 such that the grading implement 26 removes a layer of soil from a current soil surface 120 as the work vehicle 10 is moved in the forward direction 42. Specifically, in several embodiments, the controller 124 may be communicatively coupled to the various components of the work vehicle 10 and/or the system 100, such as the PRVs 102, 110. In this regard, as the work vehicle 10 is moved in the forward direction 42, the controller 104 may be configured to control the depth and/or angle of the grading implement 26 such that the grading implement 26 removes a layer of soil of a desired thickness from the current soil surface 120. For example, in one embodiment, the controller 124 may be configured to transmit suitable control signals (e.g., as indicated by dashed lines 132, 134 in FIGS. 2, 3, 5, and 6) to the PRVs 102, 110 such that PRVs 102, 110 regulate the volume of fluid within the chambers 58, 60, 74, 76 of the actuators 38, 40 so as to position the grading implement 26 at the desired angle relative to the arms 34, 26 and/or at the desired depth relative to the chassis 24. The grading implement 26 is shown in FIGS. 2 and 3 as removing a layer of soil from the initial ungraded soil surface 122, which, in the instance shown, corresponds to the current soil surface 120. It should be appreciated that the controller 124 may be configured to control the grading implement 26 while the work vehicle 10 is moved over the current soil surface 120 in the forward direction 42 several times.

In several embodiments, the controller 124 may be configured to control the grading implement 26 to remove soil from the current soil surface 120 based on a selected offset soil depth (such as a first offset soil depth 136 or a second offset soil depth 138). In general, the grading implement 26 may be used to remove soil from the current soil surface 120 while the work vehicle 10 is moved in the forward direction 42 until the current soil surface 120 is at the offset soil depth 136, 138. As shown, the offset soil depth 136, 138 differs from a desired final soil depth 140 of a final graded soil surface 142. As used herein, the final graded soil surface 142 refers to soil surface after all grading operations, such as grading operations in accordance with method 200 described below with reference to FIG. 7, have been completed. In the illustrated embodiment, the first offset soil depth 136 is less than the final soil depth 140. That is, an offset soil surface 144 at the first offset soil depth 136 is shallower relative to the initial ungraded soil surface 122 than the final graded soil surface 142. Conversely, the second offset soil depth 138 is greater than the final soil depth 140. That is, an offset soil surface 146 at the second offset soil depth 138 is deeper relative to the initial ungraded soil surface 122 than the final graded soil surface 142.

The system 100 may be configured to determine when the current soil surface 120 is at the selected or desired offset soil depth 136, 138. Specifically, as shown in FIG. 2, in one embodiment, controller 124 may be communicatively coupled to the sensor 116 via a wired or wireless connection to allow measurement signals (e.g., indicated by dashed lines 148 in FIGS. 2, 5, and 6) to be transmitted from the sensor 116 to the controller 124. The controller 124 may then be configured monitor the current soil depth 118 of the current soil surface 120 relative to the initial ungraded soil surface 122 based on the measurement signals 148 received from the sensor 116. For instance, the controller 124 may include a look-up table or suitable mathematical formula stored within its memory 128 that correlates the sensor measurements to the current soil depth 118 of the current soil surface 120. In this regard, the controller 124 may be configured to compare the current soil depth 118 to the selected offset soil depth 136, 138 to determine when the current soil depth 118 is the same as the offset soil depth 136, 138. In one embodiment, the controller 124 may be configured to notify the operator of the work vehicle 10 when the current soil surface 120 is at the selected offset soil depth 136, 138, such as via a visual and/or an audible notification through the user interface 130.

As indicated above, the embodiment of the system 100 shown in FIG. 3 does not include the sensor 116. In such embodiment, the controller 124 may be communicatively coupled to the user interface 130 via a wired or wireless connection to allow user input signals (e.g., indicated by dashed line 150 in FIG. 3) to be transmitted from the user interface 130 to the controller 124. As such, the controller 124 may configured to receive a notification from the operator of the work vehicle 10 when the current soil surface 120 is at the selected offset soil depth 136, 138.

Figure 4:
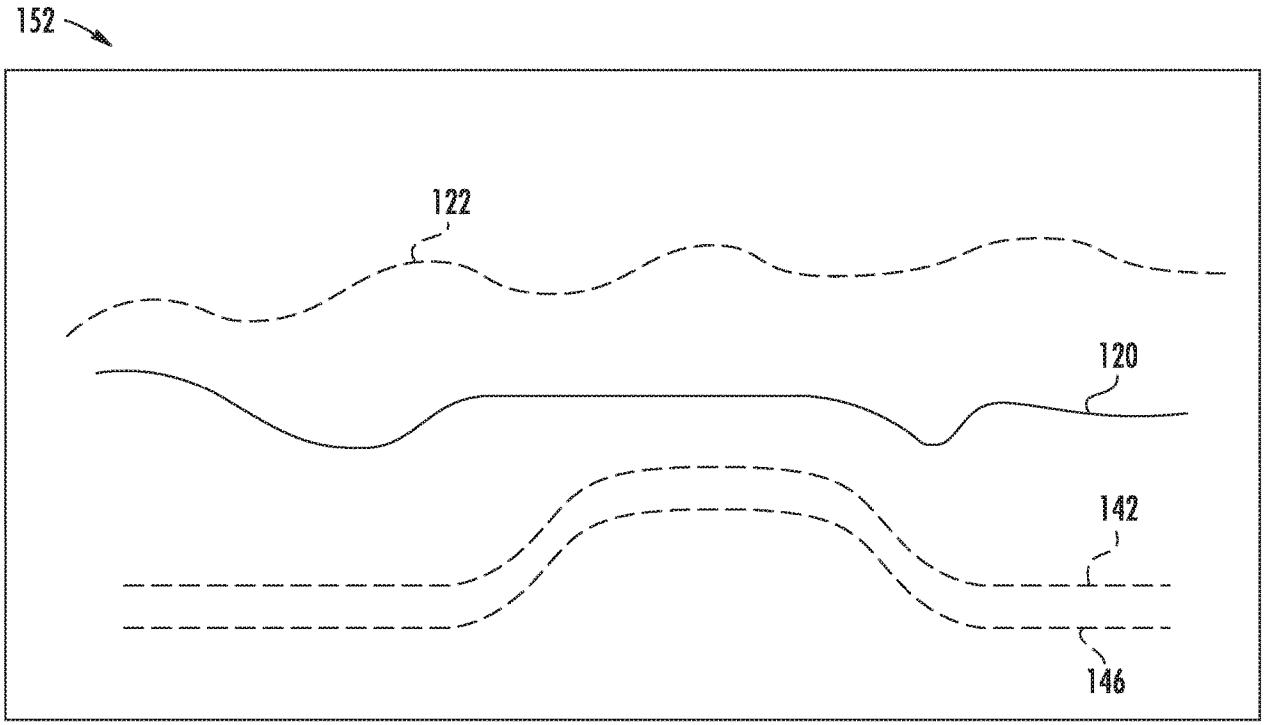
FIG. 4 illustrates a graphical view of an example soil topography map charting a geographical distribution of a current soil depth of a current soil surface, an offset soil depth of an offset soil surface, and a final soil depth of a final graded surface relative to an initial ungraded soil surface in accordance with aspects of the present subject matter.

Referring now to FIG. 4, the controller 124 may be configured to control the grading implement 26 to remove soil from the current soil surface 120 while the work vehicle 10 is moved in the forward direction 42 based on a soil topography map 152. In certain instances, the selected offset soil depth 136, 138 may vary with geographical position. As such, the soil topography map 152 may correlate the offset soil depth 136, 138 to a geographical position or location. In this regard, the controller 124 may be configured to control the depth and/or angle of the grading implement 26 so as to form the offset surface 144, 146 having the desired geographical topography. In one embodiment, the soil topography map 152 may be stored in the memory device 128 of the controller 124. Furthermore, in some embodiments, the system 100 may include a GPS receiver configured to monitor the geographical location of the work vehicle 10.

An example topography map 152 is shown in FIG. 4. Specifically, as shown, in one embodiment, the soil topography map 152 may show the geographical correlation between the initial ungraded soil surface 122, the current soil surface 120, the final graded soil surface 142, and the offset soil surface 146. In one embodiment, the controller 124 may be configured to update the soil topography map 152 based on changes in the current soil surface 120. For example, the controller 124 may be configured to update the soil topography map 152 to show the current soil surface 120 as being closer to the first offset soil surface 136 as the grading implement 26 removes successive layers of soil. It should be appreciated that the soil topography map 152 may only show the geographical variation of some of the initial ungraded soil surface 122, the current soil surface 120, the final graded soil surface 142, and the offset soil surface 146. Furthermore, the soil topography map 152 may show the geographical variation of additional parameters. In addition, although FIG. 4 illustrates the soil topography map 152 as a two dimensional map, the soil topography map 152 may be a three dimensional map.

Moreover, in several embodiments, the controller 124 may be configured to store a plurality of preselected first offset soil depths 136 and/or second offset soil depth 138 (e.g., in the memory device(s) 128). As such, when the operator of the work vehicle 10 selects one of the preselected offset depths 136, 138, the controller 124 may be configured to control the position of the grading implement 26 so as to remove soil from the current soil surface 120 until the offset soil surface 144, 146 is at the selected preselected offset depth 136, 138. For example, in one embodiment, each preselected offset depth 136 may correspond to a desired thickness of loose soil on the final graded soil surface 142 for planting different types of grass (e.g., rye, fescue, etc.). However, the preselected offset depths 136, 138 may be based on any suitable criteria. In some embodiments, the preselected offset depths 136, 138 may be stored in derived from field data and imported into the controller 124. As such, in one embodiment, the preselected offset depths 136, 138 may be imported into the controller 124 as part of the soil topography map 152 or when the soil topography map 152 is being imported. Furthermore, the controller 124 may be configured to store a preselected offset depth 136, 138 provided by the operator during operation of the work vehicle 10 (e.g., the user interface 130). Such operator-provided preselected offset depth 136, 138 may be based on a commonly repeated offset depth 136, 138 that is not already stored within the controller 124.

Figure 5:
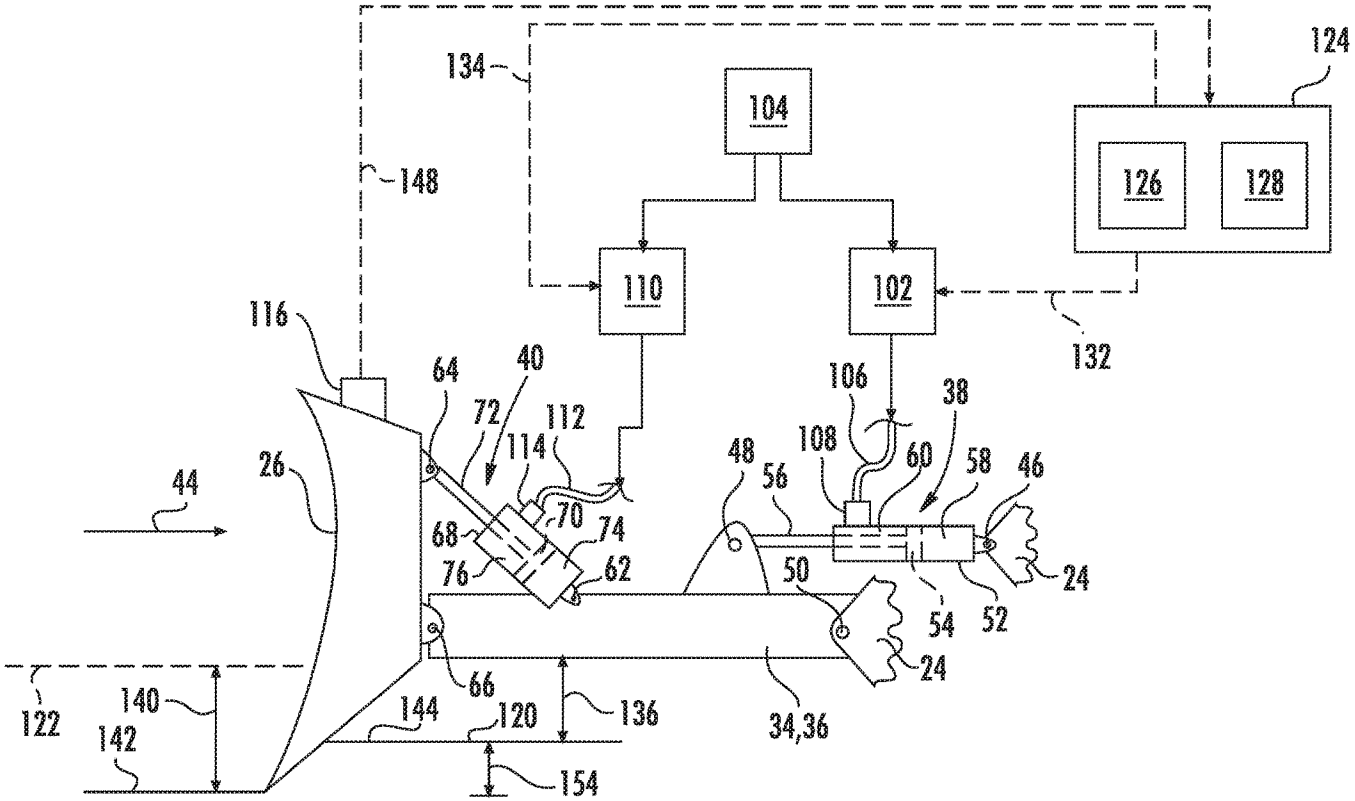
FIG. 5 illustrates a schematic view of the embodiment of the system shown in FIG. 2, particularly illustrating the system being configured to control a grading implement to remove soil to create the final graded soil surface when an offset soil depth is less than the final soil depth.

Referring now to FIG. 5, when the selected offset soil depth corresponds to the first offset soil depth 136 and the current soil surface 120 is at such depth 136, the controller 124 may be configured to control the position of the grading implement 26 so as to remove soil based on a depth differential 154 defined between the first offset soil depth 136 and the final soil depth 140 to create the final graded soil surface 142 as the work vehicle 10 is moved in the reverse direction 44. Specifically, in several embodiments, the controller 124 may be configured to control the depth and/or angle of the grading implement 26 so as to remove a layer of soil from the offset soil surface 144 corresponding to the depth differential 154 while the work vehicle 10 is moved in the reverse direction 44. When formed by removing a layer of soil from the offset soil surface 144, the final graded soil surface 142 may generally be of a hard, compacted nature that is suitable for constructing buildings and/or roads thereon. Since the grading implement 26 may generally be positioned forward of the track assemblies 30, 32, the grading implement 26 removes any grooves or indentations formed by the track assemblies 30, 32 by forming the final graded soil surface 142 while the work vehicle 10 is moved in the reverse direction 44.

Figure 6:
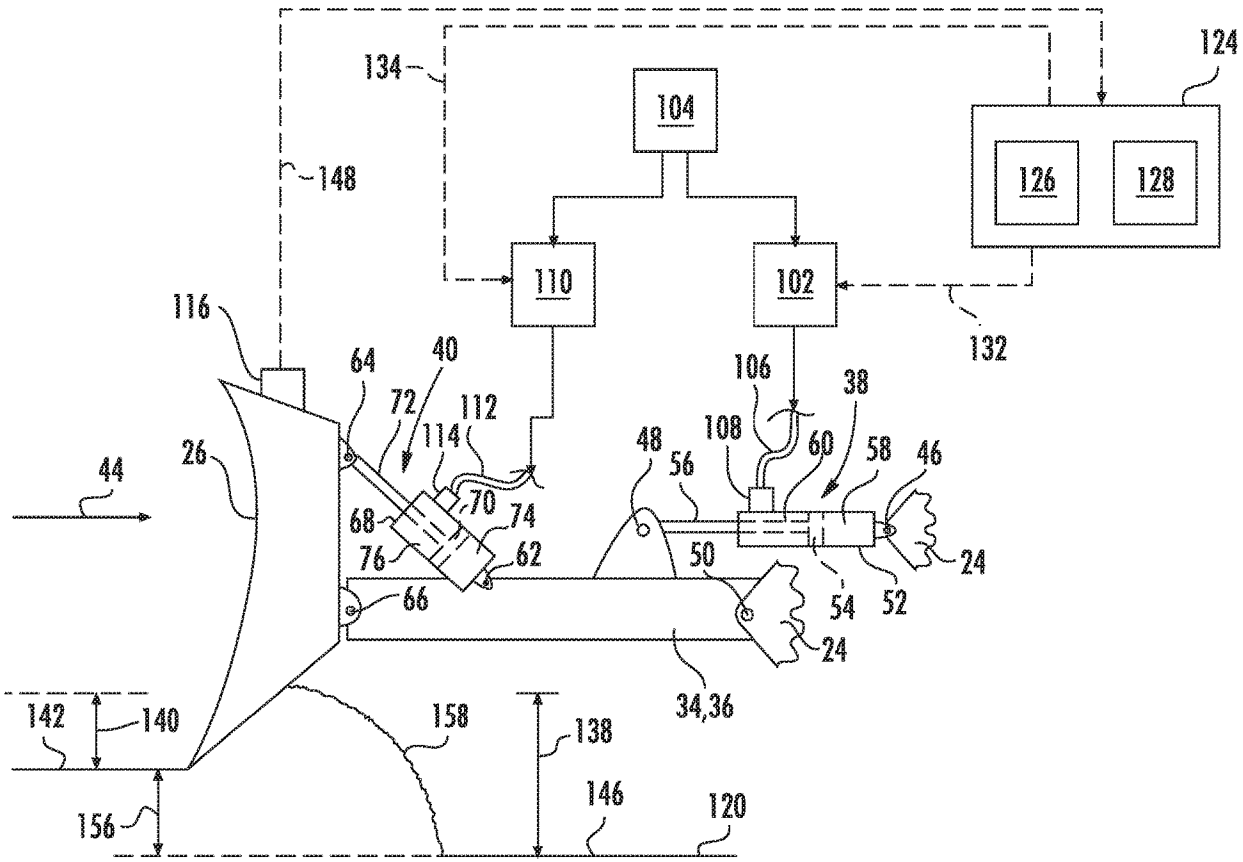
FIG. 6 illustrates a schematic view of the embodiment of the system shown in FIG. 2, particularly illustrating the system being configured to control a grading implement to add soil to create the final graded soil surface when an offset soil depth is greater than the final soil depth.

Referring now to FIG. 6, when the selected offset soil depth corresponds to the second offset soil depth 138 and the current soil surface 120 is at such depth 138, the controller 124 may be configured to control the position of the grading implement 26 so as to add soil based on a depth differential 156 defined between the second offset soil depth 138 and the final soil depth 140 to create the final graded soil surface 142 as the work vehicle 10 is moved in the reverse direction 44. Specifically, in several embodiments, the controller 124 may be configured to control the depth and/or angle of the grading implement 26 so as to add a layer of soil to the offset soil surface 146 corresponding to the depth differential 146 while the work vehicle 10 is moved in the reverse direction 44. For example, the grading implement 26 may spread a volume of soil 158 onto the offset soil surface 146. When formed by adding a layer soil to the offset soil surface 146, the final graded soil surface 142 may generally be of a loose, non-compacted nature that is suitable for planting grass or other vegetation thereon. Since the grading implement 26 may generally be positioned forward of the track assemblies 30, 32, the grading implement 26 removes any grooves or indentations formed by the track assemblies 30, 32 by forming the final graded soil surface 142 while the work vehicle 10 is moved in the reverse direction 44.

Figure 7:
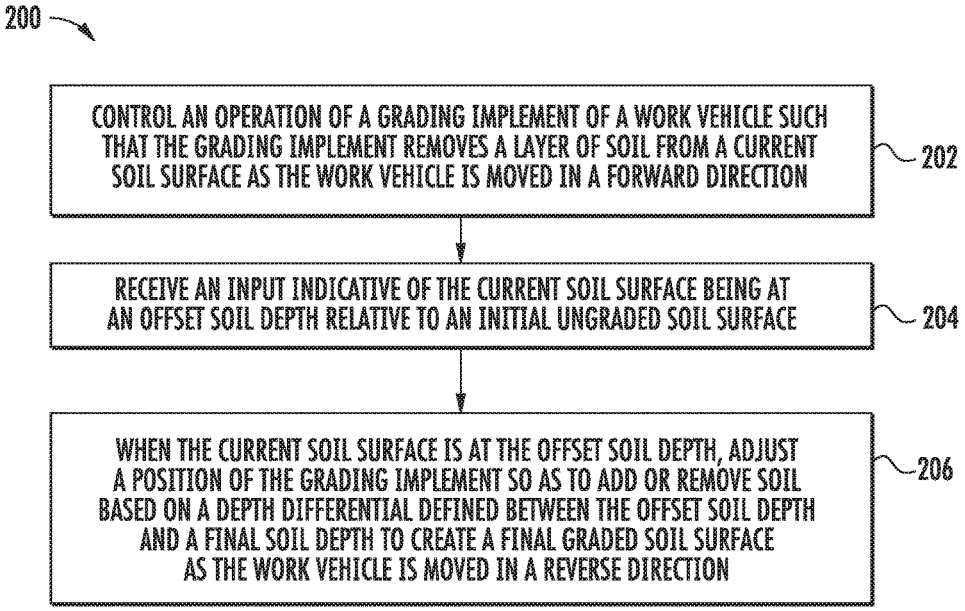
FIG. 7 illustrates a flow diagram of one embodiment of a method for creating a final graded soil surface having a final soil depth relative to an initial ungraded soil surface in accordance with aspects of the present subject matter.

Referring now to FIG. 7, a flow diagram of one embodiment of a method 200 for creating a final graded soil surface having a final soil depth relative to an initial ungraded soil surface is illustrated in accordance with aspects of the present subject matter. In general, the method 200 will be described herein with reference to the work vehicle 10 and the system 100 described above with reference to FIGS. 1-6. However, it should be appreciated by those of ordinary skill in the art that the disclosed method 200 may generally be utilized to create a final graded soil surface with any work vehicle having any suitable work vehicle configuration. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 7, at (202), the method 200 may include controlling an operation of a grading implement of a work vehicle such that the grading implement removes a layer of soil from a current soil surface as the work vehicle is moved in a forward direction. For example, in several embodiments, the controller 124 may be configured to control the operation of the grading implement 26 of the work vehicle 10 such that the grading implement 26 removes a layer of soil from a current soil surface 120 as the work vehicle 10 is moved in a forward direction 42. In one embodiment, the controller 124 may be configured to control the depth and/or angle of the grading implement 26 so as to remove soil from the current soil surface 120 while the work vehicle 10 is moved in the forward direction 42 until the current soil surface 120 is at the offset soil depth 136, 138.

Additionally, at (204), the method 200 may include receiving an input indicative of the current soil surface being at an offset soil depth relative to the initial ungraded soil surface. For example, in one embodiment, the controller 124 may be configure to monitor the current soil depth 118 of the current soil surface 120 based on the measurement signals 148 received from the sensor 116 and determine when the current soil depth 118 is the same as the offset soil depth 136, 138. In another embodiment, the controller 124 may be configured to receive a notification from an operator of the work vehicle 10, such as via user the input signals 150 transmitted from the user interface 130, when the current soil surface 120 is at the offset soil depth 136, 138.

Moreover, as shown in FIG. 7, at (206), the method 200 may include adjusting a position of the grading implement so as to add or remove soil based on a depth differential defined between the offset soil depth and the final soil depth to create the final graded soil surface as the work vehicle is moved in the reverse direction when the current soil surface is at the offset soil depth. For example, when the current soil surface 120 is at the first offset soil depth 136, the controller 124 may be configured to adjust the position of the grading implement 26 to remove soil to the offset soil surface 144 based on the depth differential 154 defined between the first offset soil depth 136 and the final soil depth 140 so as to create the final graded soil surface 142 as the work vehicle 10 is moved in the reverse direction 44. Conversely, when the current soil surface 120 is at the second offset soil depth 138, the controller 124 may be configured to adjust the position of the grading implement 26 to add soil to the second offset soil surface 146 based on a depth differential 156 defined between the second offset soil depth 138 and the final soil depth 140 to create the final graded soil surface 142 as the work vehicle 10 is moved in the reverse direction 44.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method for creating a final graded soil surface having a final soil depth relative to an initial ungraded soil surface, the method comprising:

controlling, with a computing device, an operation of a grading implement of a work vehicle such that the grading implement removes a layer of soil from a current soil surface as the work vehicle is moved in a forward direction, the work vehicle extending longitudinally between a forward end and an aft end, the grading implement being located at the forward end of the work vehicle, the grading implement traversing the current soil surface prior to the aft end of the work vehicle when work vehicle is moved in the forward direction, the aft end of the work vehicle traversing the current soil surface prior to the grading implement when work vehicle is moved in a reverse direction;

receiving, with the computing device, an input indicative of the current soil surface being at an offset soil depth relative to the initial ungraded soil surface, the offset soil depth differing from the final soil depth; and when the current soil surface is at the offset soil depth, adjusting, with the computing device, a position of the grading implement so as to add or remove soil based on a depth differential defined between the offset soil depth and the final soil depth to create the final graded soil surface as the work vehicle is moved in the reverse direction.

2. The method of claim 1, further comprising:

controlling, with the computing device, a depth of the grading implement or an angle of the grading implement to add soil to create the final graded soil surface when the offset soil depth is greater than the final soil depth.

3. The method of claim 2, further comprising:

controlling, with the computing device, the depth of the grading implement or the angle of the grading implement based on a parameter associated with soil settlement when adding soil to create the final graded soil surface.

4. The method of claim 1, further comprising:

controlling, with the computing device, a depth of the grading implement or an angle of the grading implement to remove soil to create the final graded soil surface when the offset soil depth is less than the final soil depth.

5. The method of claim 1, further comprising:

controlling, with the computing device, the grading implement to remove soil from the current soil surface based on the offset soil depth while the work vehicle is moving in the forward direction until the current soil surface is at the offset soil depth.

6. The method of claim 1, further comprising:

controlling, with the computing device, the grading implement to remove soil from the current soil surface based on a soil topography map correlating the offset soil depth to a geographical position while the work vehicle is moving in the forward direction until the current soil surface is at the offset soil depth.

7. The method of claim 1, further comprising:

receiving, with the computing device, a notification from an operator of the work vehicle when the current soil surface is at the offset soil depth.

8. The method of claim 1, further comprising:

monitoring, with the computing device, a current soil depth of the current soil surface based on measurement signals received from a sensor; and determining, with the computing device, when the current soil depth is the same as the offset soil depth.

9. The method of claim 8, further comprising:

notifying, with the computing device, an operator of the work vehicle when the current soil surface is at the offset soil depth.

10. The method of claim 8, further comprising:

updating, with the computing device, a soil topography map based on changes in the current soil depth.

11. A system for creating a final graded soil surface having a final soil depth relative to an initial ungraded soil surface, the system comprising:

a work vehicle extending longitudinally between a forward end and an aft end, the work vehicle including a grading implement positioned at the forward end of the work vehicle, the work vehicle configured to be moved in both a forward direction and a reverse direction, the grading implement traversing a current soil surface prior to the aft end of the work vehicle when the work vehicle moves in the forward direction, the aft end of the work vehicle traversing the current soil surface prior to the grading implement when the work vehicle moves in the reverse direction; and a controller communicatively coupled to the work vehicle, the controller being configured to position the grading implement at an offset soil depth relative to the initial ungraded soil surface such that the current soil surface is graded to the offset soil depth as the work vehicle is moved in the forward direction across the soil surface, the offset soil depth differing from the final soil depth, wherein, when the current soil surface is at the offset soil depth, the controller is configured to adjust the position of the grading implement so as to add or remove soil based on a depth differential defined between the offset soil depth and the final soil depth to create the final graded soil surface as the work vehicle is moved in the reverse direction across the soil surface.

12. The system of claim 11, wherein the controller is further configured to control a depth of the grading implement or an angle of the grading implement to add soil to create the final graded soil surface when the offset soil depth is greater than the final soil depth.

13. The system of claim 12, wherein the controller is further configured to control the depth of the grading implement or the angle of the grading implement based on a parameter associated with soil settlement when adding soil to create the final graded soil surface.

14. The system of claim 11, wherein the controller is further configured to control a depth of the grading implement or an angle of the grading implement to remove soil to create the final graded soil surface when the offset soil depth is less than the final soil depth.

15. The system of claim 11, wherein the controller is further configured to control the grading implement to remove soil from the current soil surface based on the offset soil depth while the work vehicle is moving in the forward direction until the current soil surface is at the offset soil depth.

16. The system of claim 11, wherein the controller is further configured to control the grading implement to remove soil from the current soil surface based on a soil topography map correlating the offset soil depth to a geographical position while the work vehicle is moving in the forward direction until the current soil surface is at the offset soil depth.

17. The system of claim 11, wherein the controller is further configured to receive a notification from an operator of the work vehicle when the current soil surface is at the offset soil depth.

18. The system of claim 11, wherein the controller is further configured to monitor a current soil depth of the current soil surface based on measurement signals received from a sensor and determine when the current soil depth is the same as the offset soil depth.

19. The system of claim 18, wherein the controller is further configured to notify an operator of the work vehicle when the current soil surface is at the offset soil depth.

20. The system of claim 18, wherein the controller is further configured to update a soil topography map based on changes in the current soil depth.

* * * * *